US005409412A

United States Patent [19]

Colon

[11] Patent Number: 5,409,412

[45] Date of Patent: Apr. 25, 1995

[54] FLOTATION REHABILITATION EXERCISER

[76] Inventor: Jose A. Colon, 202 Wall St., Tintillo, Guaynabo, Puerto Rico, 00966

[21] Appl. No.: 247,145

[22] Filed: May 20, 1994

[51] Int. Cl.[6] ..... B63C 9/08

[52] U.S. Cl. ..... 441/129; 114/61

[58] Field of Search ..... 441/129–132, 441/35, 43–46, 136; 602/32; 606/241; 482/66, 69; 114/61, 123, 352–354, 283

[56] References Cited

U.S. PATENT DOCUMENTS

| | | | |
|---|---|---|---|
| 1,752,630 | 4/1930 | Brown | 114/61 |
| 2,946,068 | 7/1960 | Jasper | 441/130 |
| 4,443,204 | 4/1984 | Perrin | 441/129 |
| 4,552,540 | 11/1985 | Bass | 441/129 |
| 4,569,340 | 2/1986 | Burton | 128/75 |
| 4,580,988 | 4/1986 | Correll | 441/130 |
| 4,722,329 | 2/1988 | Kalvg | 128/75 |
| 4,798,550 | 1/1989 | Biancucci | 441/129 |

FOREIGN PATENT DOCUMENTS

| | | | |
|---|---|---|---|
| 379869 | 8/1923 | Germany | 441/130 |

*Primary Examiner*—Edwin L. Swinehart
*Attorney, Agent, or Firm*—Oblon, Spivak, McClelland, Maier & Neustadt

[57] ABSTRACT

A flotation exerciser especially though not exclusively adapted for use in the rehabilitation of patients who may be atrophied from long confinement to bed. The exerciser has an upstanding frame supporting a harness by suspension straps connected to the harness at upper and lower positions. The straps are freely slidable over strap supports on the frame whereby a user may move easily from a vertical position to either face-up or face-down, substantially prone positions by merely leaning his torso forwardly or backwardly.

9 Claims, 6 Drawing Sheets

FLOTATION REHABILITATION EXERCISER

FIELD OF THE INVENTION

This invention relates to flotation exercisers of the type wherein a user such as a recuperating, long bedridden, perhaps atrophied patient is partially supported in water and partially supported by the exerciser to speed his rehabilitation back to strength and health.

BACKGROUND OF THE INVENTION

Flotation exercisers are known, for example, such as that shown in the patent to Perrin U.S. Pat. No. 4,443,204. The Perrin exerciser has no auxiliary support that is, sling or harnesses, for the patient and should he be weak and severely atrophied from a long period of bed confinement, the Perrin exerciser could be dangerous. The patent to Kalvåg U.S. Pat. No. 4,722,329 is a flotation device including a pyramidal upstanding frame between floats. In this case a patent with a lumbar back ailment is simply suspended in a vest from the frame with the expectation that his weight plus a weighted belt will stretch the patient's back and alleviate his ailment. The patient can propel himself and the unit by paddling and swiveling about a vertical axis but that is all the patient can do.

There are also swimming aids where a healthy but inexperienced swimmer is belted by a flexible connector such as chain or rope to an overhead floating framework. Such arrangements are shown in the patent to Brown U.S. Pat. No. 1,752,630 and Biancucci U.S. Pat. No. 4,798,550. These units are solely for use by swimmers and would be unsuitable for extremely weak patients who need to exercise arms and legs, initially too weak for swimming. A common lack of all known prior art is the absence of a rigid horizontal exercise bar easily grasped by a user for moving his body either up or down or to and fro for exercising his arms.

SUMMARY OF THE INVENTION

It is an object of the invention to provide an improved flotation exerciser which enables a weak and possibly atrophied but recovering patient to be more quickly rehabilitated with less stress than is possible using dry land rehabilitating techniques such as walkers which provide little exercise for the arms and may be extremely tiring for the legs even over a short distance.

It is a more specific object of the invention to provide a flotation rehabilitating device which initially enables a patient to exercise his arms and legs against water resistance and also enables a patient to change his position from vertical to either face-down or face-up substantially prone positions by merely shifting his body weight in one direction or the other while being supportedly by the flotation device to the extent necessary to ensure that the patient is never in danger.

The foregoing objects are achieved by providing a body harness having suspension straps connected at one end to the harness at the back adjacent the upper end of the patient's torso and also connected at the other end to the harness adjacent the lower end of the patient's torso. The suspension straps define bights which pass freely slideably over raised support members with the arrangement being such that when the patient leans in the direction of a face-down prone position, his weight automatically slides the bights of the suspension straps through the support units and vice versa when he leans backwards.

Further advantages of the invention will become apparent when the following detailed description is read in conjunction with the accompanying drawings wherein:

DETAILED DESCRIPTION OF THE INVENTION

Figure 1:
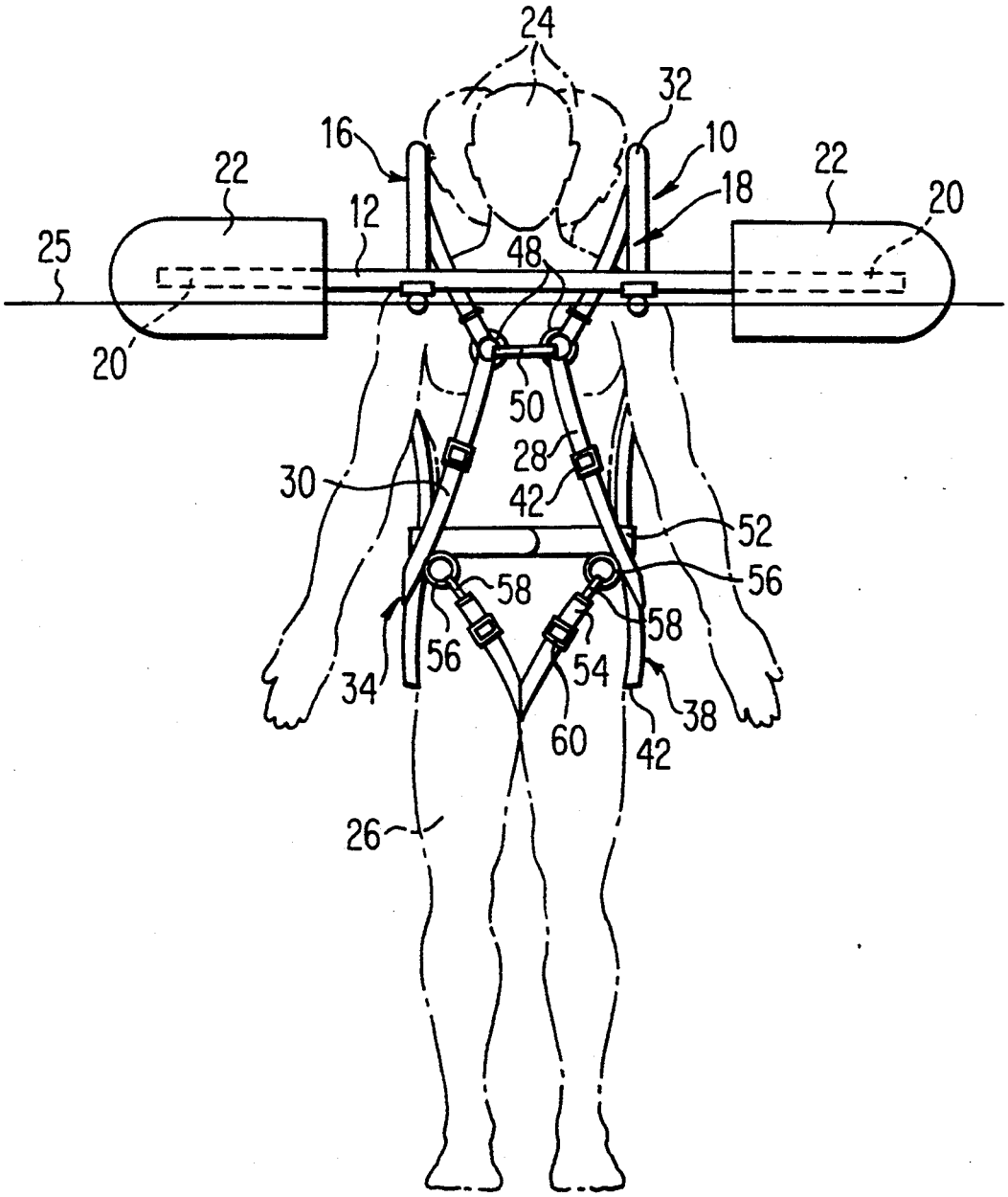
FIG. 1 is a vertical front elevational view of a patient received in the exerciser of the invention.

The flotation exercising device of the invention comprises a frame 10 having front and rear laterally extending, horizontally spaced bars 12, 14 and a pair of inverted U-shaped laterally spaced side bars 16, 18 rigidly connected in any convenient manner at their opposite ends to the front and rear bars 12, 14, respectively. The front and rear bars 12, 14 have end parts 20 extending laterally beyond their connection with the side bars 16, 18 and a float 22 of any suitable flotation material such as foamed styrene is carried by each extending end part 20 of the front and rear bars 12, 14 to maintain the frame floating on the surface 23 of a body of water. The floats 22 have ample buoyancy to support a patient, even a heavy patient, with his head and neck 24 well above water level 25, and the floats are laterally elongated and sufficiently widely spaced to resist any tendency of the frame to capsize.

Figure 2:
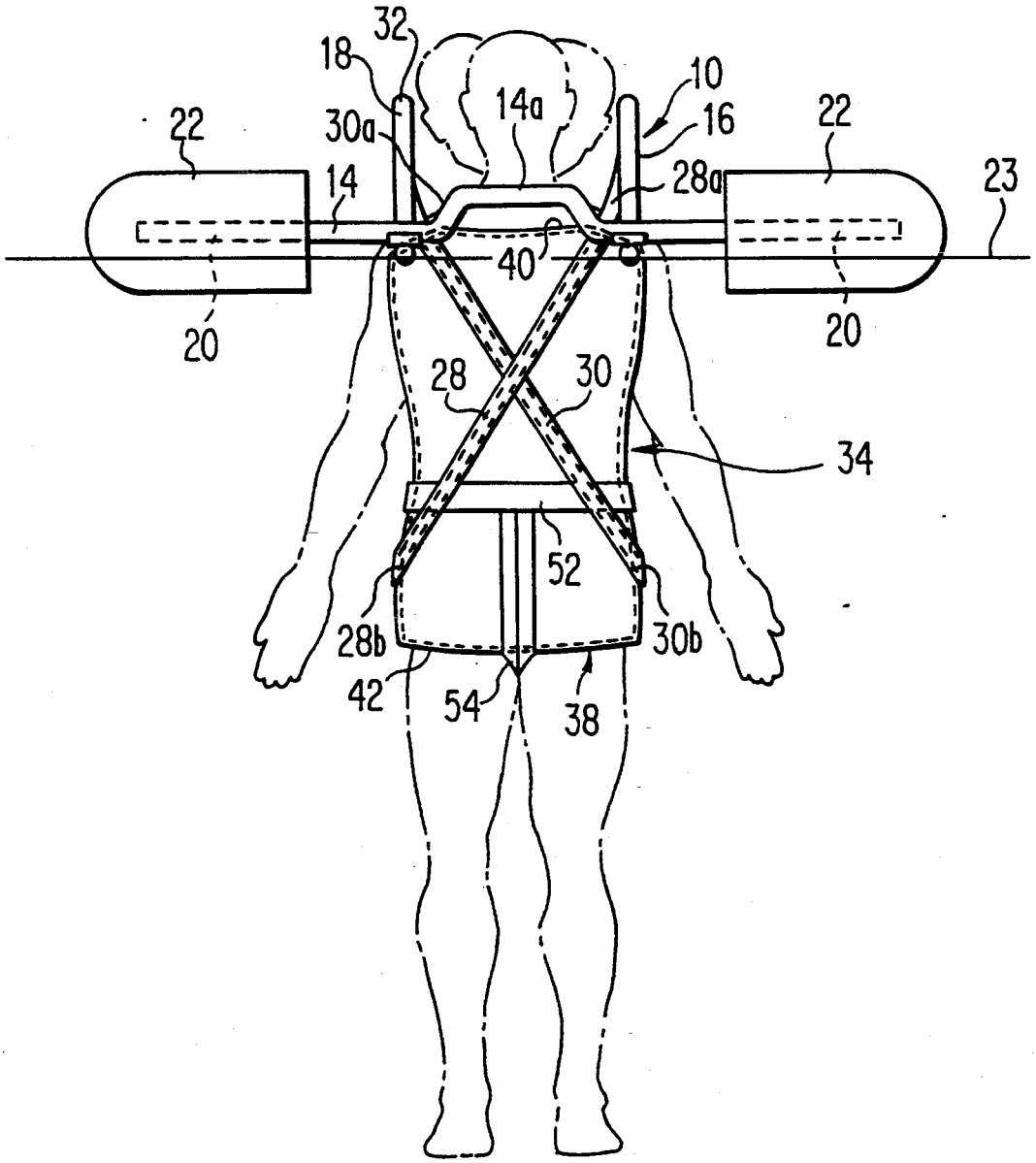
FIG. 2 is a vertical rear elevational view thereof.

As can be seen in FIGS. 1 and 2 the spacing between the side bars 16, 18 is of a size to accommodate with substantial clearance the head 24 of a user 26 disposed between the side bars 16, 18 and facing the front bar 12. Suspension straps 28, 30 are suspended by means to be described from upper-most parts 32 (FIG. 3) of the inverted U-shaped side bars 16, 18, and an adjustable harness, broadly designated by the numeral 34 and described in detail below, is connected to the suspension straps 28, 30 and is of a size for attachment about the limbs and torso of the user.

Figure 3:
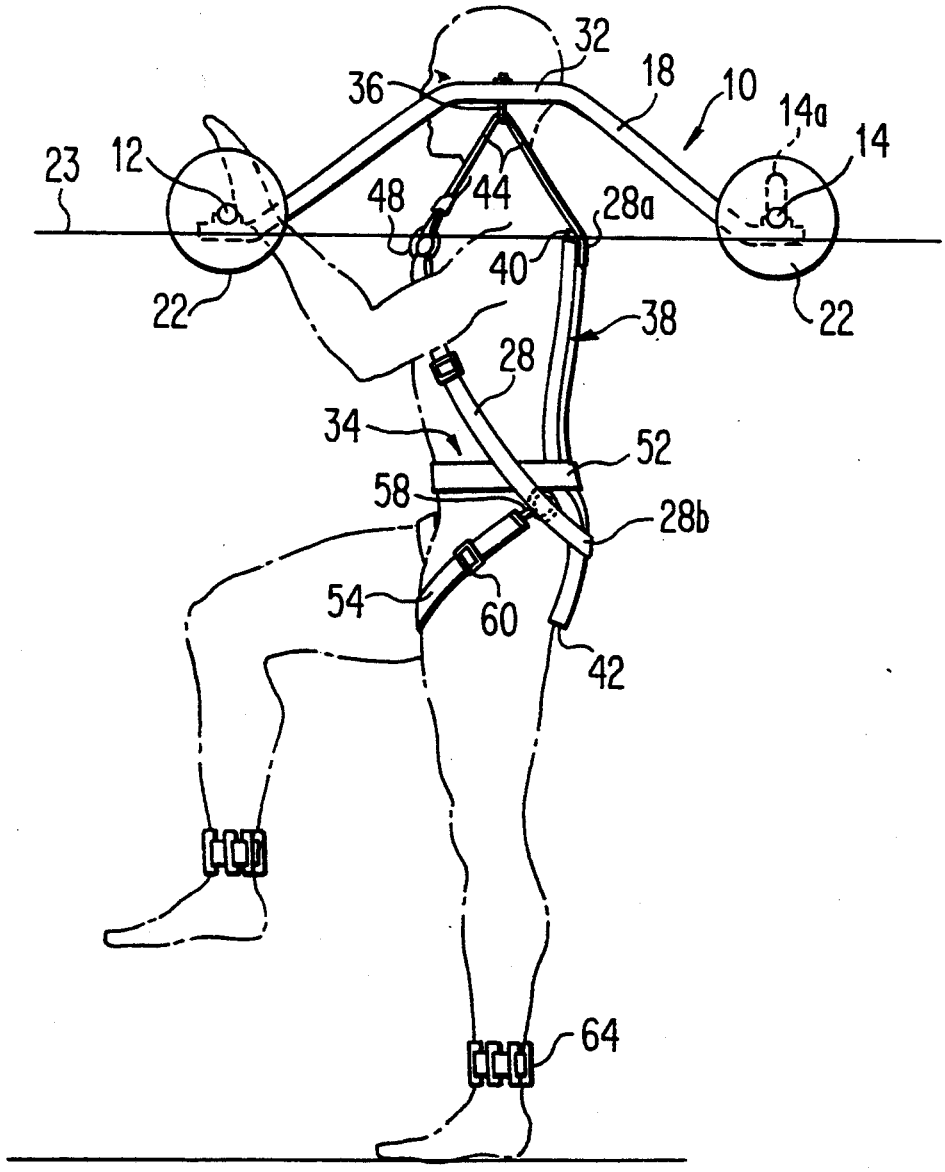
FIG. 3 is a side elevational view thereof showing a patient exercising while standing on the bottom of a pool of water.
Figure 6:
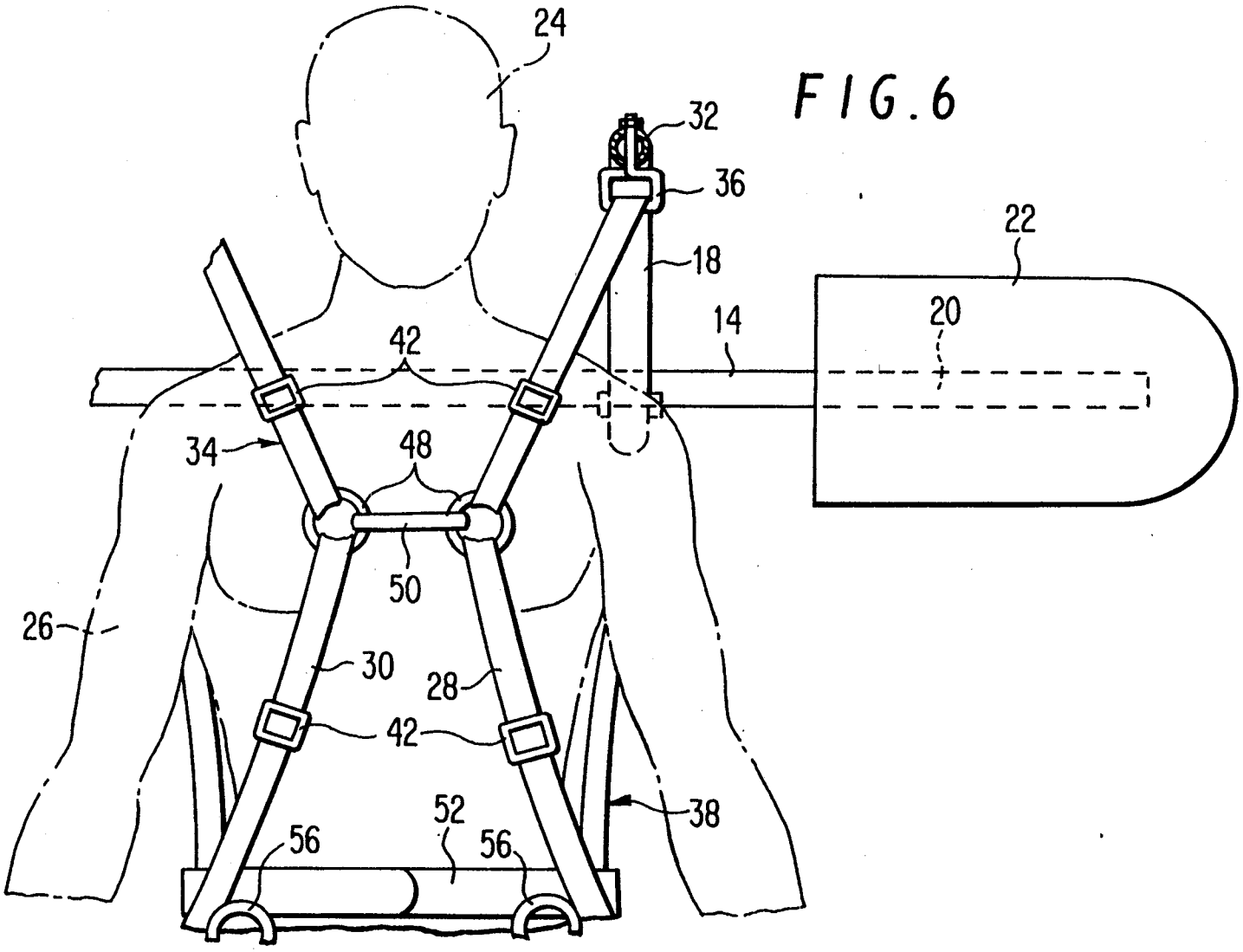
FIG. 6 is an enlarged, broken, partial cross-sectional front elevational view showing details of the invention.

With reference now to FIG. 6, a strap connector 36, which is preferably a rectangular eye bolt, is carried by the uppermost part 32 of each inverted U-shaped side bar 16, 18. The harness 34, which includes the suspension straps 28, 30, also includes a back part 38 having an upper end 40 (FIG. 2) terminating adjacent a user's shoulders and a lower end 42 terminating below a user's waist. As best seen in FIG. 3 the suspension straps 28, 30 have upper ends **28*a*, 30*a*, which are connected, as by stitching, to the upper end 40 of the back part 38 of the harness and lower ends 28*b*, 30*b* which are connected to the back part 38, at least no higher than a user's waist and preferably substantially below the waist. The suspension straps 28, 30 are designed to pass over the user's chest as best seen in FIG. 1, and have lengths defining bights 44 between their connections with the lower and upper ends of the back part (FIGS. 3 and 4) which extend freely slideably through the strap connectors 36, the lengths of the suspension straps 28, 30 being adjustable by conventional strap adjuster 42, best seen in FIG. 6**, to suit the size or height of the wearer.

The suspension straps 28, 30 may be composed of two parts joined together by rings 48 which, in turn, are connected together across a user's chest by a quick-release connector 50 which may be a conventional snap hook.

Figure 4:
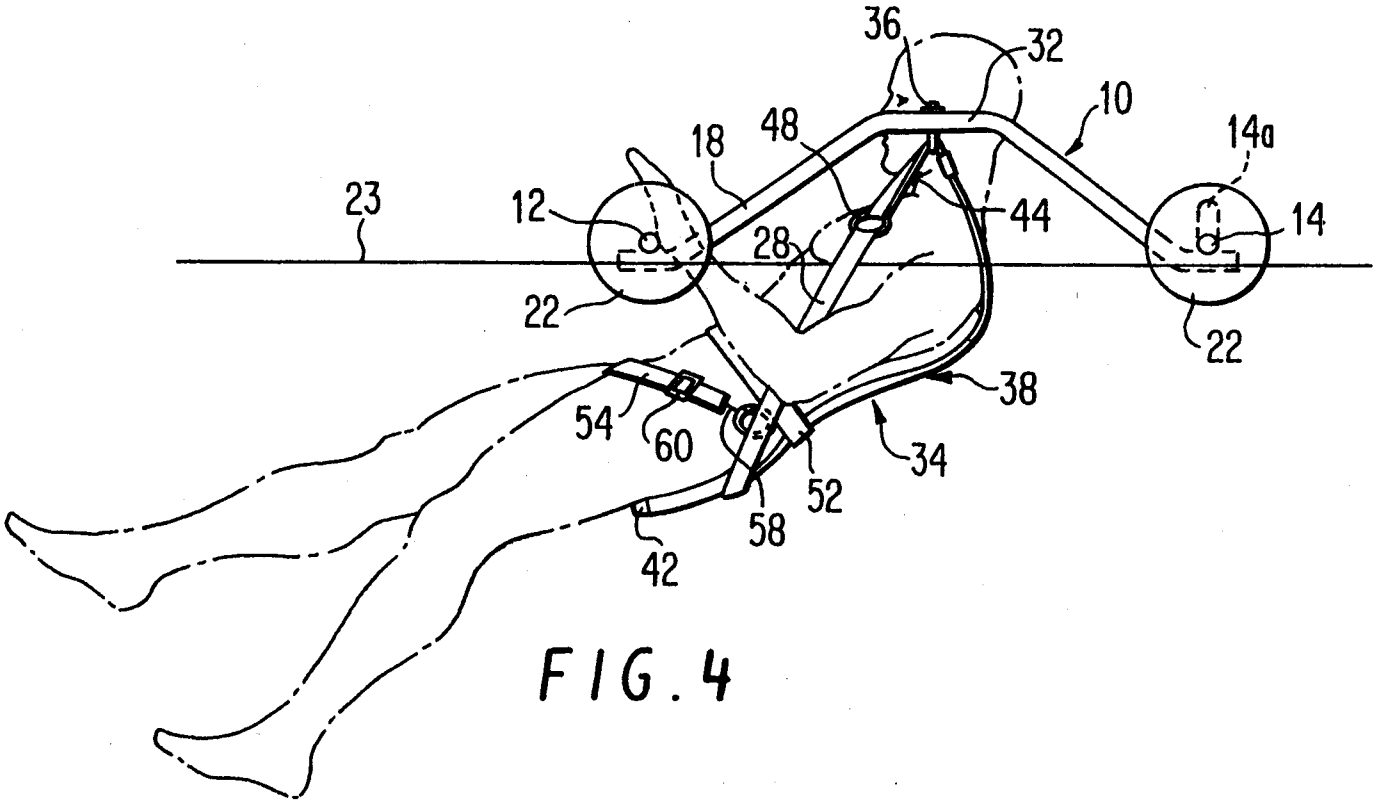
FIG. 4 is a side elevational view showing the patient in a substantially prone face-up position.
Figure 5:
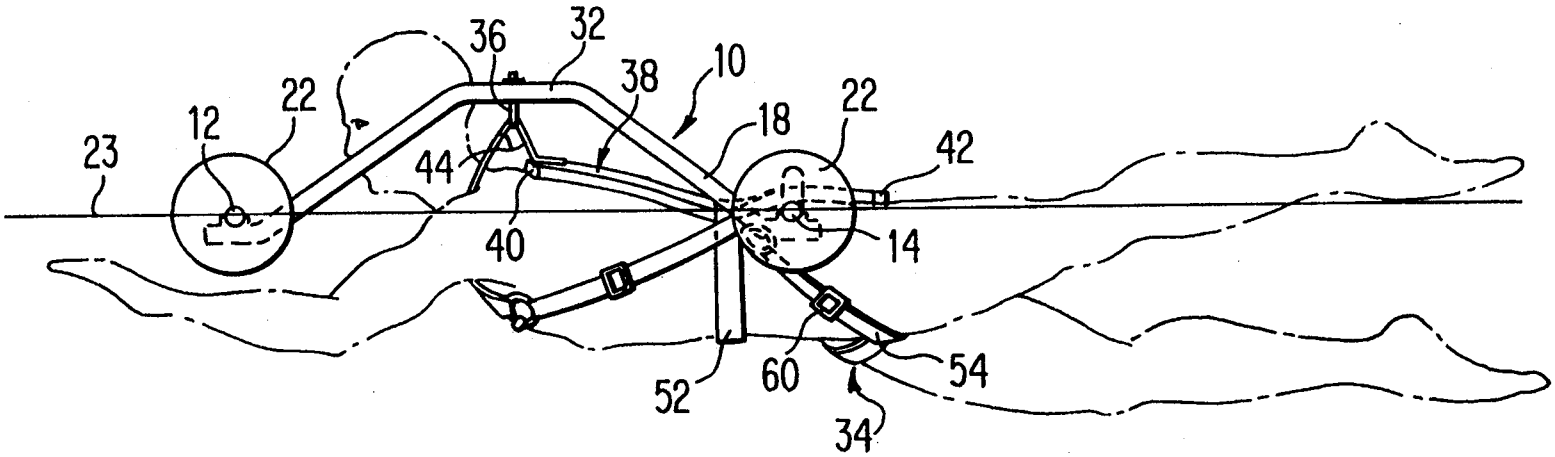
FIG. 5 is a side elevational view showing the patient in a substantially prone face-down swimming position.

With reference to FIGS. 4 and 5 it can be seen that the horizontal spacing between the front and rear bars 12, 14, relative to the strap connector 36 is of a size to enable a user received in the harness to select a position by directing the weight of his torso forwardly or backwardly to shift from a vertical position to substantially prone face-up or face-down positions, as in FIGS. 4 and 5, respectively, without the user's head engaging the front or rear bars 12, 14. Desirably, the rear bar 14 has an inverted U-shaped bend 14*a* therein to accommodate the rear end of a user in a face-down substantially prone swimming position as shown in FIG. 5.

Preferably, the back part 38 of the harness is a unitary member of a size to cover substantially the entire back of a user as should be clear in FIG. 2. The back part may be made of two layers of heavy mesh nylon fabric stitched together edge to edge. The harness further includes an adjustable waist and back-part encircling belt 52 and a pair of crotch straps 54 which extend from the lower end 42 of the back support and between the user's legs to the waist belt. The waist belt may carry rings 56 to which the ends of the crotch straps may be connected by quick-release connectors 58 which may be conventional snap hooks. The length of the crotch straps 54 may be adjusted by conventional strap adjusters 60. For further strength and support the suspension belts 28, 30 may be secured in crosswise fashion to the back part 38 as in FIG. 2.

An important feature of the present invention is that it permits a possibly enfeebled patient to change his position from vertical to face-up or face-down substantially prone positions by simply leaning forwardly or backwardly whereby the unbalancing weight of his torso causes the bights 44 of suspension straps 28, 30 to automatically run through the eyes of the strap connectors 36 whereby, regardless of the patient's selected position, he is at all times uniformly supported by the suspension straps and floats 22. This is a vast improvement over flotation apparatus where the patient merely hangs vertically from a floating elevated frame as in the Kalv g patent. In the Brown unit used by swimmers it would be impossible for a patient to stand vertically on the bottom of a pool for leg and arm exerciser as in FIG. 3 of the present application and easily shift his position vertical to near prone while being always supported by the flotation harness. For vertical use, after a patient is strapped in the harness, he can wade along the sloping bottom of a pool until he senses that he is being more or less completely supported by the harness and floats. He may then raise and lower his feet alternatively with weights 64 encircling his ankles as seen in FIG. 3. He may at the same time push and pull with his arms on the front bar 12. As the patient's strength improves with time he may simply lean forward to a swimming, face down position as in FIG. 5 and swim with kicking movement of his legs and breast stroke or dog paddle movement of his arms. The patient may elect to lean backwards to the face-up position of FIG. 4 in which the legs may be moved in a variety of ways such as by kicking, frog-leg action, etc., with the arms being simultaneously moved or not as appropriate. In any event, the front bar 12 is always within easy reach for grasping by the patient either for exercising or support.

It will be apparent to those skilled in this art that the invention is susceptible of a variety of changes and modifications without, however, departing from the scope and spirit of the appended claims.

What is claimed is:

1. A flotation exercise device for the treatment or rehabilitation of invalids and the like users comprising a frame having front and rear, laterally extending, horizontally spaced bars and a pair of inverted U-shaped laterally spaced side bars rigidly connected at opposite ends to said front and rear bars, said front and rear bars having end parts extending laterally beyond their connections with said side bars, a float carried by each extending end part of said front and rear bars the lateral spacing between said side bars being of a size to accommodate with substantial clearance the head of a user disposed between said bars and facing said front bar, a suspension strap suspended from an upper-most part of each of said inverted U-shaped side bars, and an adjustable harness connected to said suspension straps and of a size for attachment about the limbs and torso of a user.

2. The device of claim 1 including a strap connector carried by the upper-most part of each inverted U-shaped side bar, said harness including a back part having an upper end terminating adjacent a user's shoulders and a lower end terminating below a user's waist, said suspension straps having upper ends connected to the upper end of the back part of said harness and lower ends connected to said back part at least no higher than the waist of a user, said suspension straps having lengths defining bights which extend freely slidable through said strap connectors, the lengths of said suspension straps being adjustable to suit the size of individual user's.

3. The device of claim 2 wherein the horizontal spacing between said front and rear bars relative to said strap connector is of a size to enable a user received in said harness to shift his position by directing the weight of his torso either forwardly or backwardly to shift from vertical to either substantially prone face-up or face-down positions without interference of the user's head by either said front bar or said rear bar.

4. The device of claim 3 wherein the said front bar is located relative to said strap connector in a position enabling a user to grasp said bar with his hands for the purpose of support or arm exercises.

5. The device of claim 3 wherein said rear bar has an inverted U-shaped bend therein of a size to accommodate the rear end of a user in a face-down substantially prone swimming position.

6. The device of claim 2 wherein said back part of said harness is a unitary member of a size to cover a substantial portion of a user's back, said harness including further an adjustable waist and back part encircling belt and a pair of adjustable crotch straps for extending from the lower end of said back part between the user's legs to said waist belt.

7. The device of claim 6 including a quick-release connector for joining said two suspension straps across the chest of the user.

8. The device of claim 7 including quick-release connectors for joining said crotch straps with said waist belt.

9. The device of claim 1 wherein said floats are laterally elongated and sufficiently widely spaced to resist any tendency of the frame to capsize.

* * * * *